United States Patent [19]

Nakamura et al.

[11] 4,424,255

[45] Jan. 3, 1984

[54] BACKING SHEET FOR CUSHIONED FLOOR

[75] Inventors: Motofumi Nakamura, Tokyo; Koji Horimoto; Motoyasu Yusawa, both of Yamaguchi, all of Japan

[73] Assignee: Mitsui Petrochemical Industries, Ltd., Tokyo, Japan

[21] Appl. No.: 400,065

[22] Filed: Jul. 20, 1982

[30] Foreign Application Priority Data

Jul. 31, 1981 [JP] Japan ..... 56-121277

[51] Int. Cl.[3] ..... B32B 5/16

[52] U.S. Cl. ..... 428/283; 162/146; 162/160; 428/288; 428/290; 428/323; 428/325

[58] Field of Search ..... 162/145, 158, 146, 181.1, 162/160; 428/212, 220, 288, 290, 323, 325, 283

[56] References Cited

U.S. PATENT DOCUMENTS 3,920,508 11/1975 Yonemori ..... 162/168
4,245,689 1/1981 Grard et al. ..... 162/146

FOREIGN PATENT DOCUMENTS 52-47049 11/1977 Japan .
55-148150 11/1980 Japan .

*Primary Examiner*—James J. Bell
*Attorney, Agent, or Firm*—Armstrong, Nikaido, Marmelstein & Kubovcik

[57] ABSTRACT

Disclosed is improvement of heat-stability of a backing sheet for cushioned floor during foaming step of gelled polyvinyl chloride resin. The backing sheet comprises a thermoplatic resin fibrous material, another fibrous material and an inorganic filler, to which a phenolic antioxidation agent or a phosphitic antioxidation agent is added.

6 Claims, No Drawings

BACKING SHEET FOR CUSHIONED FLOOR

BACKGROUND OF THE INVENTION

1. Field of the Invention

The present invention concerns an improved sheet to be used for backing a cushioned floor.

2. State of the Art

There has been widely used various cushioned floor using foamed sheet of polyvinyl chloride and the like, particularly, those of long products on which fancy patterns are given by printing and/or embossing.

Typical steps of manufacturing these kind of cushioned floor are as follows: coating polyvinyl chloride resin paste containing a foaming agent on a fibrous substract sheet, preheating the paste to gel it, printing desired picture thereon, and then heating to cause foaming. Addition of a foaming-suppresor or accelerator to the printing ink gives the embossing which follows the printed pattern.

As the fibrous substrate sheet, there has been mainly used asbestos cloth. Asbestos cloth easily breaks when bent, and shrinkage thereof during manufacturing the sheet is different from that of the resin, which causes warp of the flooring material. Also, use of asbestos is objected to from a viewpoint of labor and public health.

It was proposed to use, as a substrate sheet to replace asbestos cloth, a sheet made by papermaking a thermoplastic resin fibrous material (A) and another fibrous material (B) which does not melt at the melting, point of (A), and heating thus papermade sheet to melt (A) for adhesion (Japanese patent diclosure No.148150/1980).

Thermoplastic resin fibrous materials suitable for adhesion are mentioned later. Among them, preferable one is the product called "synthetic pulp" made of polyolefin such as polyethylene. As the other fibrous material to be used in combination with the above fibrous material, cellulose-based fiber, particularly, wood pulp is preferable.

The substrate sheet prepared by mixing and papermaking these two kinds of the fibrous materials and heat-treating has been widely accepted because of the merits that it solves the above problem in the substrate using asbestos, that is gives good appearance to the cushioned floor when applied on the floor, and that is is less expensive. However, the substrate requires careful handling in view of the relatively low heat-resistance. This is because it is experienced that the mixed-papermade sheet, when filler of an inorganic substance, such as caoline, bentonite, clay, talk, diatomite, burned gypsum, glass fiber or the like is added thereto, tends to change the color, or scorch during the step of foaming, the polyvinyl chloride gel when heated to a temperature higher than 200° C.

Use of the inorganic filler is preferable or even necessary because not only it gives desirable weight to the substrate sheet, but also it has effect of controlling the adhesion of the thermoplastic fibrous material at the preheating so that dimensional stability of the substrate sheet may be heightened. Also, high heating temperature of the foaming step is an inevitable condition required by use of foaming agent having a high decomposition point for the purpose of sufficient gellation in the step prior to the foaming.

SUMMARY OF THE INVENTION

The object of the present invention is to provide a backing sheet for cushioned floor which is free from the scorching at the foaming.

The backing sheet which is improved in accordance with the present invention comprises a fibrous material of thermoplastic resin, another fibrous material which does not melt at the melting point of the thermoplastic resin, and an inorganic filler, and is characterized in that the backing sheet contains at least one of heat-stabilizer selected from phenolic antioxidation agents and phosphitic antioxidation agents.

PREFERRED EMBODIMENTS OF THE INVENTION

Typical phenolic antioxidation agents used as the heat-stabilizer in the present invention are styrene-derived alkyl phenols having the structure of formula (I) below:

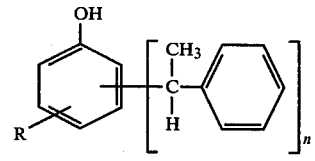

(I)

wherein, R stands for hydrogen atom or an alkyl group of $C_mH_{2m+1}$, m being an integer from 1 to 10; and n is an integer from 1 to 3.

Examples of the styrene-derived alkyl phenols of formula (I) are distyryl phenol and distyryl cresol.

Typical phosphitic antioxidation agents used as the heat-stabilizer in the present invention are trialkyl- or triaryl phosphite of formula (II) below:

$$P(OR')_3 \qquad (II)$$

wherein R' stands for an alkyl group of $C_xH_{2x+1}$ —, x being an integer from 10 to 20; or an aryl group of

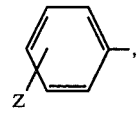

wherein Z stands for hydrogen atom, or an alkyl group of $C_yH_{2y+1}$, y being an integer from 1 to 20.

Examples of trialkyl phosphites of formula (II) are tridecyl phosphite, trioctadecyl phosphite and tristearyl phosphite; and examples of triaryl phosphites of formula (II) are triphenyl phosphite and trinonylphenyl phosphite.

Any heat-stabilizer may be used alone or in combination of two or more thereof. In cases of combined use, synergistic effect can be expected.

As the thermoplastic resin fibrous material composing the improved backing sheet according to the present invention, it is preferable to use fine fibrous material of a polyolefin such as polypropylene, ethylene/propyhlene copolymer, ethylene/1-butene copolymer and ethylene/4-methyle-1-pentene copolymer as well as the above mentioned polyethylene. Production of the preferred fine fibrous material may be carried out using a flash spinning method described in, for example, U.S. Pat. No. 3,920,508.

The other fibrous material which does not melt at the melting point of the thermoplastic resin may be cellulosic fiber such as wood pulp for papermaking, bark fiber pulp, regenerated pulp, and cotton linter. Also, organic synthetic fiber, aromatic polyamide fiber, polyimide fiber and polyester fiber are suitable.

Among the above mentioned fibrous materials of the latter group, cellulosic fiber, particularly, wood pulp is the most preferable in view of gratitude to expansion and shrinkage of the backing sheet and the price.

Examples of the inorganic filler are mentioned above, and among them, clay, caoline, and diatomite are typical.

Composition of the backing sheet should be, by weight, 10 to 50 parts, preferably 20 to 40 parts of the thermoplastic resin fibrous material, also 10 to 50 parts, preferably 20 to 40 parts of the other fibrous material, and 5 to 60 parts, preferably 15 to 50 parts of the inorganic filler. These components may be mixed and papermade to form a sheet by conventional method.

The above noted heat-stabilize, use of which characterizes the present invention, is added in an amount chosen in balance of the heat-stabilizing effect thereof and the heating temperature used in the production of the sheet. A suitable amount will be found in the range of 0.5 to 5% by weight based on the total weight of the above two fibrous materials.

Mixed-papermaking is carried out usually in a wet process, i.e., in aqueous medium, and therefore, it is necessary to improve dispersibility of oil-type heat-stabilizers. One of the practical way of addition is to form an aqueous emulsion by using a surface active agent in an amount of 1 to 50% by weight based on the heat-stabilizer, and to add thus obtained emulsion at the step of papermaking. Another way is to impregnate the heat-stabilizer in the sheet, after the papermaking, using a sizing-pressing machine or a coater of various types. In the latter way, though the heat-stabilizers may be applied as they are, it is preferably to use them in the form of aqueous emulsion so that it may penetrate well into the sheet.

The backing sheet according to the present invention, which is made by mixed-papermaking the thermoplastic resin fibrous material and the other fibrous material with the inorganic filler, is free from coloration or scorch at the step of foaming. Further advantages of the present backing sheet are: that smoother surface of coated resin paste is obtained because it is possible to use a large amount of the inorganic filler and a higher heating temperature (this is remarkable when the resin paste is that of polyvinyl chloride.), that the amount to be absorbed by the substrate sheet may be decreased, and that the foaming rapidly occurs to heighten productibity.

EXAMPLE

The following materials were mixed and papermade in wet process ("parts" are by weight, dry basis):

synthetic pulp made of polyethylene as the thermoplastic resin fibrous material: 30 parts
wood pulp as the other fibrous material: 30 parts
diatomite as the inorganic filler: 40 parts At the step of papermaking, the heat-stabilizers shown in the Table were added in the form of aqueous emulsion in the amount as shown in the Table. The amounts of addition are of course based on the total % by weight of the two fibrous materials.

The papermade sheets containing the heat-stabilizer were kept in an oven to heat at 220° C. for 1 to 5 minutes, and then, taken out to cool and inspect coloration or scorch.

The results of the above thermal test are shown in the Table. In the runs with an asterisk mark * scorch occurred, and in the runs without the mark, no scorch was observed. It will be clearly understood that the backing sheet of the present invention is sufficiently resistant to heating of usual period and temperature.

TABLE

| Heat Stabilizer | | Heating Period (minute) | | | | |
|---|---|---|---|---|---|---|
| Chemical Compound | Amount % by weight | 1 | 2 | 3 | 4 | 5 |
| None | — | | * | * | * | * |
| distyryl phenol | 0.2 | | * | * | * | * |
| | 0.5 | | | | * | * |
| | 1.0 | | | | | * |
| | 2.0 | | | | | * |
| | 5.0 | | | | | * |
| | 7.0 | | | | | * |
| distyryl cresol | 0.2 | | * | * | * | * |
| | 0.5 | | | | * | * |
| | 1.0 | | | | | * |
| | 2.0 | | | | | * |
| tristearyl phosphite | 0.2 | | * | * | * | * |
| | 0.5 | | | | * | * |
| | 1.0 | | | | * | * |
| | 2.0 | | | | | * |
| triphenyl phosphite | 0.2 | | * | * | * | * |
| | 0.5 | | | | * | * |
| | 1.0 | | | | * | * |
| | 2.0 | | | | | * |
| trinonylphenyl phosphite | 0.2 | | * | * | * | * |
| | 0.5 | | | | * | * |
| | 1.0 | | | | * | * |
| | 2.0 | | | | | * |
| | 5.0 | | | | | * |
| | 7.0 | | | | | * |
| trinonyl phenyl phosphite and | 1.0 | | | | | * |
| distyryl phenol | 1.0 | | | | | |
| distyryl cresol | 0.5 | | | | | * |
| and triphenyl phosphite | 0.5 | | | | | |
| distyryl cresol | 1.0 | | | | | * |
| and triphenyl phosphite | 1.0 | | | | | |

We claim:

1. A backing sheet for a cushioned floor comprising a fibrous material of thermo-plastic resin, another fibrous material which does not melt at the melting point of the thermoplastic resin, and an inorganic filler, characterized in that the backing sheet contains 0.5 to 5%, based on the total weight of the fibrous materials, of at least one heat-stabilizer selected from the group consisting of the styrene-derived alkyl phenol type antioxidation agent of the formula (I):

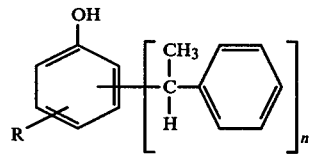

(I)

wherein R stands for hydrogen atom or an alkyl group of $C_mH_{2m+1}$, m being an integer from 1 to 10; and n is an integer from 1 to 3; and the trialkyl-or triaryl phosphite antioxidation agent of the formula (II):

$$P(OR')_3 \quad \text{(II)}$$

wherein R′ stands for an alkyl group of $C_xH_{2x+1}$, x is an integer from 10 to 20, or an aryl group of

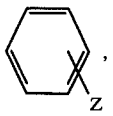

Z stands for hydrogen atom, or an alkyl group of $C_yH_{2y+1}$, y is an integer from 1 to 20.

2. A backing sheet of claim 1, in which the styrene-derived alkylphenol is a member selected from distyryl phenol and distyryl cresol.

3. A backing sheet of claim 1, in which the trialkyl phosphite is tristearyl phosphite.

4. A backing sheet of claim 1, in which the triaryl phosphite is a member selected from triphenyl phosphite and trinoylphenyl phosphite.

5. A backing sheet of claim 1, in which the sheet comprises 10 to 50 parts (by weight dry basis) of the thermoplastic resin fibrous material, 10 to 50 parts of the other fibrous material, and 5 to 60 parts of the inorganic filler; and content of the heat stabilizer is in the range of 0.5 to 5% by weight based on the total weight of the fibrous materials.

6. A backing sheet of claim 1, in which the sheet comprises 20 to 40 parts of the thermoplastic resin fibrous material, 20 to 40 parts of the other fibrous material, and 15 to 50 parts of the inorganic filler.

* * * * *